US005454181A

United States Patent [19]

Rothman et al.

[11] Patent Number: 5,454,181

[45] Date of Patent: Oct. 3, 1995

[54] ILLUMINATED SIGN FOR NAMES AND THE LIKE

[76] Inventors: Jack Rothman; Bernice Rothman, both of 292 Half Hollow Rd., Dix Hills, N.Y. 11746

[21] Appl. No.: 172,757

[22] Filed: Dec. 27, 1993

[51] Int. Cl.[6] ..... G09F 13/04

[52] U.S. Cl. ..... 40/564; 40/576

[58] Field of Search ..... 40/564, 575, 576, 40/432, 619; 362/226

[56] References Cited

U.S. PATENT DOCUMENTS

| | | | |
|---|---|---|---|
| 931,382 | 8/1909 | Cairncross | 40/576 |
| 983,593 | 2/1911 | Wortley | 40/576 |
| 1,120,876 | 12/1914 | Witz | 40/576 |
| 1,812,979 | 7/1931 | Pasini | 40/575 X |
| 2,285,907 | 6/1942 | Davis . | |
| 2,332,138 | 10/1943 | Epstein . | |
| 2,527,679 | 10/1950 | Krueger . | |
| 2,601,733 | 7/1952 | Durey . | |
| 2,607,144 | 8/1952 | Harris . | |
| 2,893,148 | 7/1959 | Figman . | |
| 3,233,090 | 2/1966 | Wagner | 40/432 X |
| 3,470,640 | 10/1969 | Knowles . | |
| 3,516,187 | 6/1970 | Espinosa . | |
| 4,254,457 | 3/1981 | Lordier . | |
| 4,387,522 | 6/1983 | Sommers-Szoszky | 40/576 |
| 4,765,080 | 8/1988 | Conti | 40/576 |
| 4,817,316 | 4/1989 | Walker | 40/576 |
| 4,839,975 | 6/1989 | Elmer | 40/564 X |
| 4,912,609 | 3/1990 | Gillette | 362/226 X |

*Primary Examiner*—Kenneth J. Dorner
*Assistant Examiner*—Joanne Silbermann
*Attorney, Agent, or Firm*—Michael I. Kroll

[57] ABSTRACT

An improved illuminated sign is provided for names and the like which consists of a housing. Transparent indicia is on the housing. A device is within the housing for producing light. The indicia can be illuminated on the housing to be easily seen at increased distances therefrom.

1 Claim, 2 Drawing Sheets

(INTERMITTENT "FLASHER" BULB MAY BE SUBSTITUTED)

ILLUMINATED SIGN FOR NAMES AND THE LIKE

BACKGROUND OF THE INVENTION

1. Field of the Invention

The instant invention relates generally to display devices and more specifically it relates to an improved illuminated sign for names and the like.

2. Description of the Prior Art

Numerous display devices have been provided in prior art. For example, U.S. Pat. Nos. 1,812,979 to Pasini; 2,285,907 to Davis; 2,332,138 to Epstein; 2,527,679 to Krueger; 2,601,733 to Durey; 2,607,144 to Harris; 2,893,148 to Figman; 3,470,640 to Knowles; 3,516,187 to Espinosa; 4,254,457 to Lordier; 4,387,522 to Sommers-Szoszky; 4,765,080 to Conti and 4,817,316 to Walker all are illustrative of such prior art. While these units may be suitable for the particular purpose to which they address, they would not be as suitable for the purposes of the present invention as heretofore described.

A display sign comprising of a housing having two vertical display walls composed of interchangeable glass plates having certain configurations thereon which are supported in guide strips. End walls are composed of glass panels. A top transparent glass panel is to admit solar light. The entire assembly of which is bound by binding strips is joined to the guide strips. Reflecting inner surfaces are on the interchangeable glass plates. A source of light is within the housing whereby the configurations are made visible by the reflected light.

An illuminated display device comprising a light-emitting imperforate panel having an opaque portion defining a front character is provided with a light-emitting portion spaced inwardly from the edges of the character. Opaque portions are spaced from the opaque character and form a background defining a similar but light-emitting rear character, directly in back of the opaque character. The width of the light-emitting character at any point being greater than the width of the light-emitting portion at the corresponding point of the opaque character but less than the overall width of the opaque character at the point. The front and rear characters being proportioned and positioned relative to each other to permit direct passage of unintercepted light rays through the back character, the light emitting portion of the front character and to permit indirect passage of light rays between the opaque portions on the two surfaces thereby to produce a glow surrounding the opaque character and defining it on the opaque background.

A light fixture and sign comprising a support, a tubular lamp mounted on the fixture and exposed along a longitudinally extending side for general room illumination. The fixture including means forming a light reflecting surface in the path of light rays from the lamp, and a sign carried by the fixture and extending longitudinally of the tubular lamp adjacent the lamp and in a direction substantially radially thereof and in the path of light rays from the lamp that are reflected from the fixture. The sign comprising a translucent backing and means for releasably holding individual letters in place against one side of the backing. The sign including also supporting brackets at opposite ends thereof, and means for adjustably mounting the brackets on the fixture.

A display sign comprising an elongated frame having upper and lower covering members therefore. A translucent means is supported between the upper and lower coverings through which light may pass. Guides are secured to the marginal edges of the upper and lower coverings. A second frame is slideably supported within the first mentioned frame and includes side rails engageable with the guides. A central flat reflecting panel is supported by the second frame. An illuminating means is supported by the second frame above and below the translucent members and spaced substantially from the plane of the central panel to direct light against the central reflecting panel.

An indicating device comprising a housing with a transparent window in the front wall thereof. A carriage is laterally adjustable side-wise within the housing to the rear of the window. A plurality of separate and individually changeable indicia, of substantially the same height as the window are mounted upon the carriage, so as to be adjustable therewith and arranged in juxtaposition to each other across the rear of the window, so as to permit a selected combination thereof to be displayed therethrough as a composite sign. The carriage is laterally adjustable a distance corresponding to approximately one-half the width of the space occupied by one of the indicia, so as to permit changing the position of the sign within the window according to the number of indicia included therein. The indicia having associated therewith at each end thereof blank means of the same background as that of the indicia and of lateral extent corresponding to that of the lateral adjustment of the carriage. A means is for mounting an electric light bulb within the housing and to the rear of the indicia exposed within the window, so as to illuminate the same for display. An electric supply connection is for the bulb.

A display unit for refrigerating cabinets, comprising a flat metallic plate resting on its lower edge and extending vertically upwardly from the top of a refrigerating cabinet. A translucent plastic shell having an open back is defined by a flange attached to the marginal edge of the plate to thereby cause the plate to close the back of the shell. The shell having an open bottom resting on the top of the refrigerating cabinet. Legs are attached to the plate and having portions extending downward behind the refrigerating cabinet for attachment to the back of the cabinet. The plastic shell being formed to provide a closed top, front and sides of a lamp enclosure. Lamps are attached to the plate within the shell for the projection of light through the shell. A means on the outside of the shell is for removably attaching advertising matter thereto.

An illuminating fluorescent house number fixture for outdoor use is provided, with replaceable and selectable plastic indicia members to be mounted along the length of a fluorescent tube An elongated enclosure with an elongated electrical component compartment receives wiring, a transformer and a starter and an elongated illumination compartment has end sockets. Plastic indicia are mounted on the fluorescent tube. The plastic indicia consists of two oppositely facing, integrally joined, box-like enclosures having open ends with transverse upwardly and downwardly extending fins having concave upper and lower contact edges closely to conform to the top and bottom curvature of the tube. Inwardly oppositely extending curved side fins tangentially are to contact the side faces of the tube.

The invention relates to a signboard with removable characters on panels of the type in use of the marquees of movie houses. The removable letters are mounted on replaceable tracks. The tracks are free floating both in a vertical and horizontal axis within a fixed sleeve secured at regular intervals on the panel and have sufficient movement to accommodate for attachment inaccuracies and differences in coefficients of expansion and contraction. The letter to track locking makes the attachments secure against the elements and against inadvertent dislodgment, all without tension in the locked position while at the same time allowing easy pull off when change is necessary. Also, the fixed sleeve mounts for the tracks provide for the first time a means for quick attachment, securing and removal of prepared panels in supplement to or in place of the letters and characters.

A receptacle is provided with a removable translucent front face on which house numbers are mounted. The rear face is apertured and a collar is crimped into the aperture by which collar the receptacle may be mounted on a conventional outdoor wall bracket.

An illuminated sign construction for displaying house numbers or the like that is constructed from simplified multiple function extruded and moulded components that are assembled in sealed relationship, and which are adapted for the mounting of selected indicia on an illuminated face.

This invention is an electrically illuminated sign, consisting of a rectangular box containing therein a fluorescent light. A cover for the box is in the form of an open frame containing therein interchangeable and interconnectable plates which are stamped into stencil type numbers, letters, or designs, and blank plates which serve as spacers. A translucent plate is located behind the stenciled plates, through which the fluorescent light passes, to illuminate the stenciled characters.

An illuminated information display apparatus comprising a rectangular frame member having top, bottom and side walls defining an elongated housing having at least one open face. Grooves are provided in opposing marginal edges of the top and bottom walls of the housing and extend the length thereof. A plurality of interlocking indicia bearing plate members are sized to be slidably received in the opposed grooves. The plate members having light transmitting and blocking portions thereon. A source of illumination is mounted interiorly of the housing. A photoelectric cell is connected to the source of illumination and is exposed to ambient light conditions for selectively activating and deactivating the source of illumination at predetermined states of ambient light.

A changeable copy sign assembly comprising a plurality of wafers each bearing a single indicium on a relatively opaque background. The wafers and a backing strip are removably retained to a face plate of the assembly at an elongated, window-like opening. The backing strip comprises opaque markings for preventing the leakage of light between adjacent wafers.

SUMMARY OF THE INVENTION

A primary object of the present invention is to provide an improved illuminated sign for names and the like that will overcome the shortcomings of the prior art devices.

Another object is to provide an improved illuminated sign for names and the like, in which indicia on a front wall of a housing can be illuminated to make the indicia easily seen at increased distances.

An additional object is to provide an improved illuminated sign for names and the like, in which some of the indicia is removeable and interchangeable, so that the sign can be changed for different situations.

A further object is to provide an improved illuminated sign for names and the like that is simple and easy to use.

A still further object is to provide an improved illuminated sign for names and the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
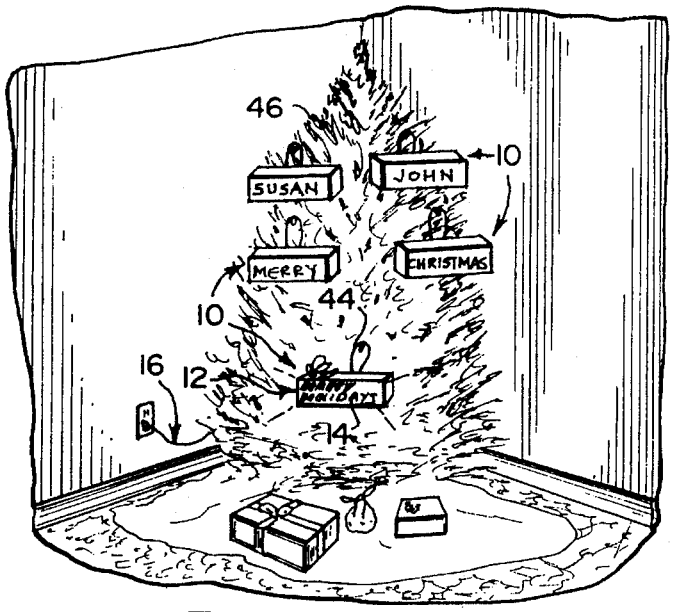
FIG. 1 is a perspective view of a Christmas tree with a plurality of first embodiments of the instant invention installed on the Christmas tree.
Figure 2:
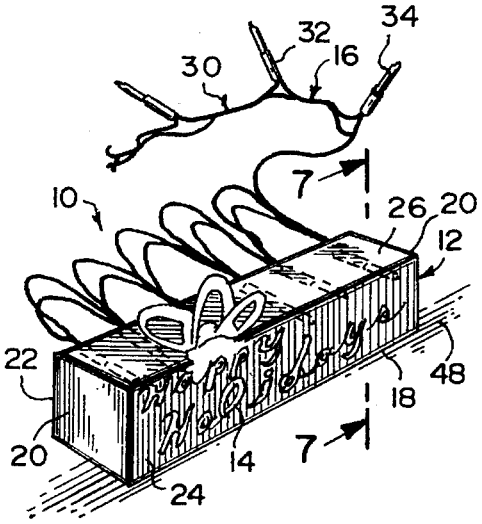
FIG. 2 is an enlarged perspective view of the first embodiment per se showing a hook up with the Christmas tree lights.

Turning now descriptively to the drawings, in which similar reference characters denote similar elements throughout the several views, FIGS. 1 through 8 illustrate an improved illuminated sign 10 for names and the like, which consists of a housing 12. Transparent indicia 14 is on the housing 12. A device 16 is within the housing 12, for producing light. The indicia 14 can be illuminated on the housing 12, to be easily seen at increased distances therefrom.

The housing 12 includes a bottom wall 18. A pair of end walls 20 are provided, with each extending upwardly from opposite sides of the bottom wall 18. A rear wall 22 extends upwardly from the back of the bottom wall 18 between the end walls 20. A front wall 24 extends upwardly from the front of the bottom wall 18 between the end walls 20. A top wall 26 extends over the bottom wall 18 between the end walls 20, the rear wall 22 and the front wall 24, forming a chamber 28 therein. The indicia 14 is located on the front wall 24 of the housing 12.

Figure 7:
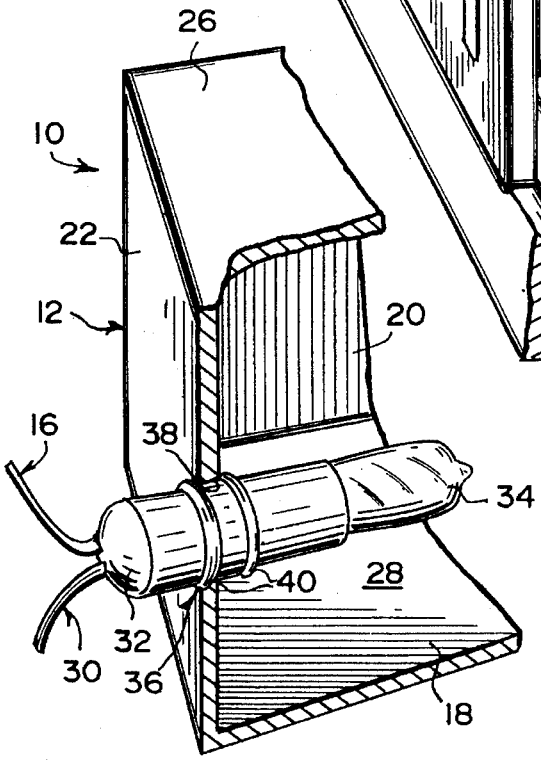
FIG. 7 is an enlarged cross sectional view taken along line 7—7 in FIG. 2 with parts broken away, showing the mounting of one of the light bulb sockets of the Christmas lights to the back wall of the housing.
Figure 8:
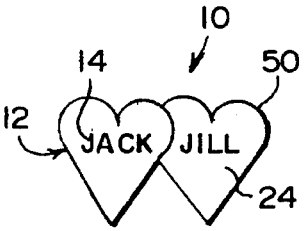
FIG. 8 is a front elevational view of a third embodiment of the instant invention.

The light producing device 16 is Christmas lights 30. The Christmas lights 30 include a plurality of light sockets 32 electrically strung together. A plurality of light bulbs 34 are carried in the light sockets 32. A structure 36, as best seen in FIG. 7, is for mounting each light socket 32 into the rear wall 22 of the housing 12, so that the light bulbs 34 will extend into the chamber 28 within the housing 12.

The mounting structure 36 consists of the rear wall 22 of the housing 12 having a plurality of apertures 38 therethrough, being of a diameter equal to that of the light sockets 32. The light sockets 32 have a pair of annular ribs 40 spaced apart at a distance equal to that of the thickness of the rear wall 22. When the light sockets 32 are inserted into the apertures 38, the annular ribs 40 will position and hold the light sockets 32 thereto.

Figure 4:
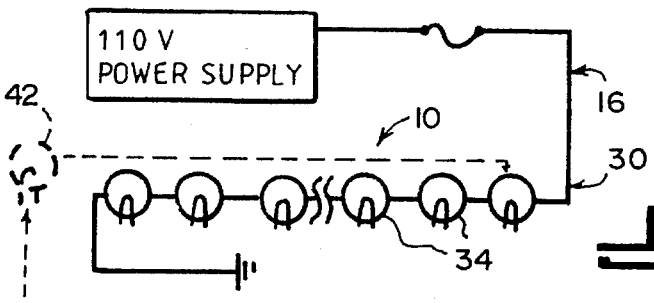
FIG. 4 is a schematic diagram of a typical electrical system thereof.

As shown in FIG. 4, one of the light bulbs 34 can be substituted with an intermittent flasher type 42 shown in phantom. This will cause the entire Christmas lights 30 to flash, since they are in a series electrical connection.

A hanger 44, as shown in FIG. 1, can be affixed to the housing 12, so that the housing 12 in a first instance can be hung on an object, such as a Christmas tree 46. In a second instance, it can be free standing on a support surface 48 shown in FIG. 2. The front wall 24 of the housing 12 can be made in various geometric shapes 50 for different decorative appearances. One typical shape, a double heart, is shown in phantom in FIG. 3 and in FIG. 8.

Figure 3:
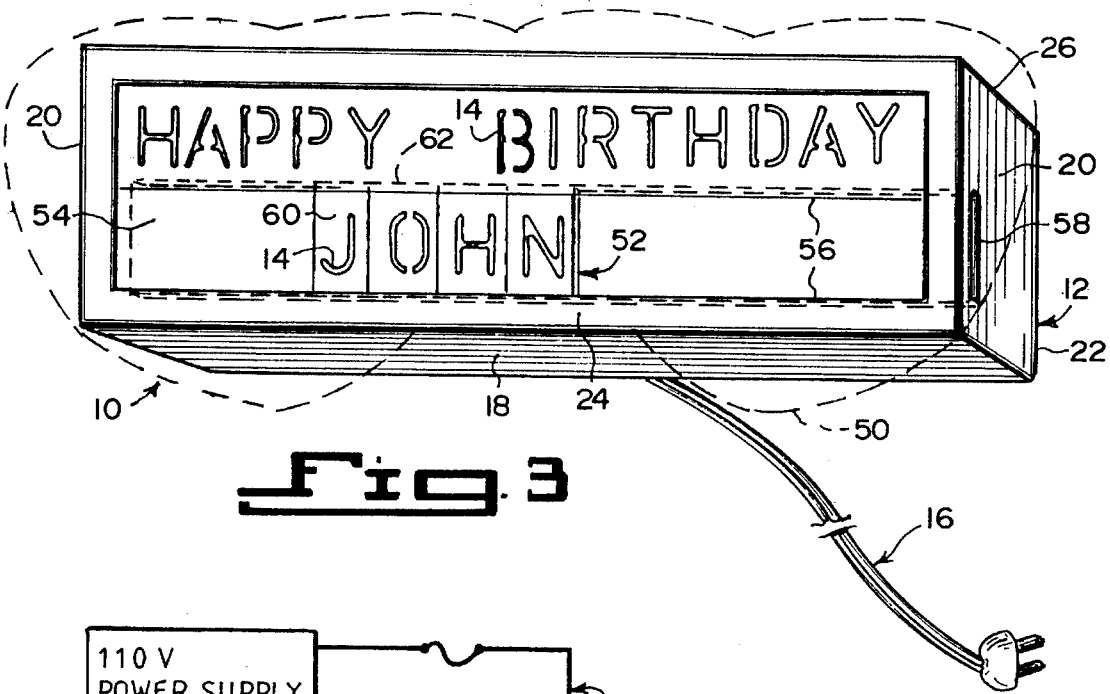
FIG. 3 is a perspective view of a second embodiment of the instant invention.
Figure 5:
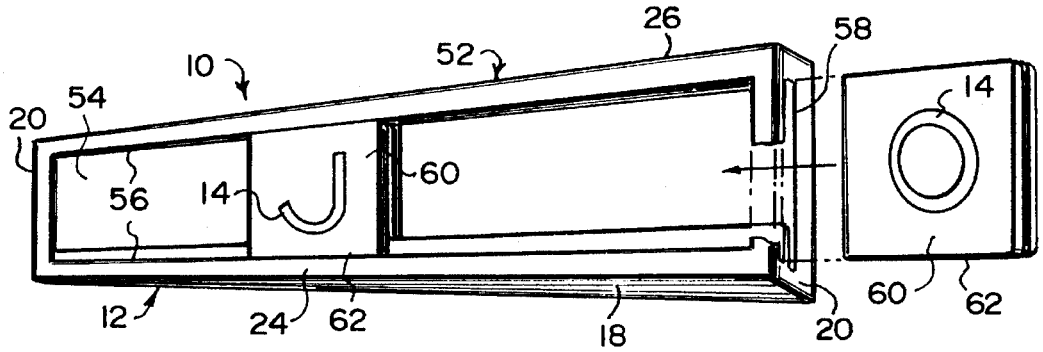
FIG. 5 is a perspective view showing the slide track of the second embodiment.
Figure 6:
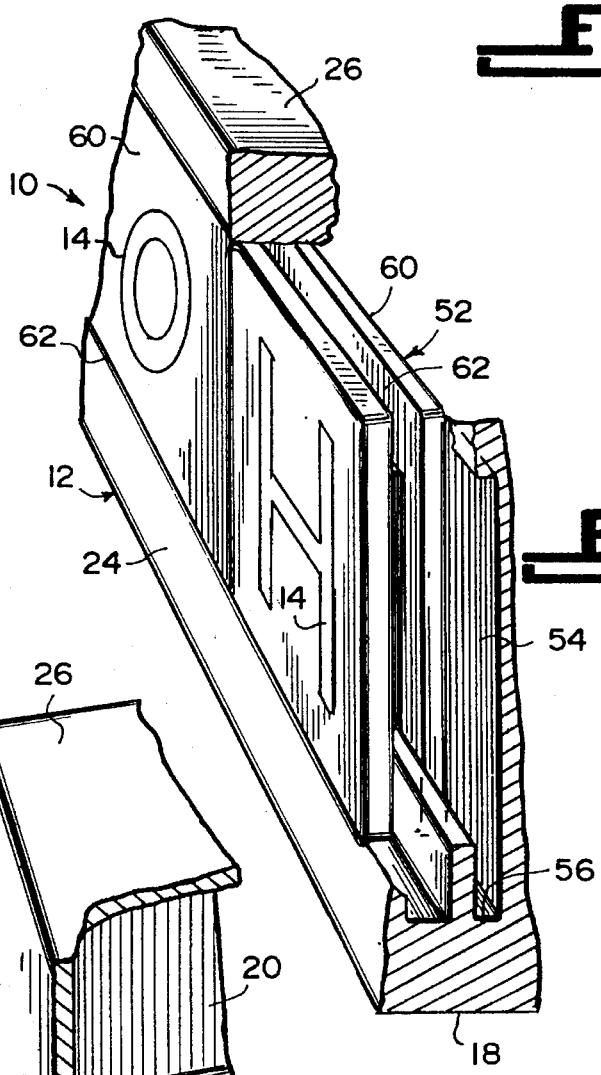
FIG. 6 is an enlarged perspective view with parts brown away showing the construction of the slide track and indicia tiles.

An assembly 52, shown in FIGS. 3, 5 and 6 is for removing and interchanging some of the indicia 14 on the front wall 24 of the housing 12 for different situations. The removing and interchanging assembly 52 includes the front wall 12 having a transparent segment 54 extending horizontally thereacross. A sliding track 56 is built into the front wall 12 at said transparent segment 54 and has a slot opening 58 located in one end wall 20. A plurality of tiles 60 are provided, with each having grooves 62 to engage with the sliding track 56.

Some of the indicia 14 is printed on each of the tiles 60. The tiles 60 in any combination can be inserted through the slot opening 58, with the grooves 62 moving along the sliding track 56, until the tiles 60 are in a side by side relationship. The indicia 14 on each tile 60 can be one letter of the alphabet. When the tiles 60 are in the side by side relationship in the sliding track 56, at least one word can be formed and viewed therefrom.

LIST OF REFERENCE NUMBERS

10 improved illuminated sign
12 housing
14 transparent indicia
16 light producing device
18 bottom wall of 12
20 end wall of 12
22 rear wall of 12
24 front wall of 12
26 top wall of 12
28 chamber in 12
30 Christmas lights
32 light socket
34 light bulb
36 mounting structure
38 aperture in 22
40 annular rib on 32
42 intermittent flasher type light bulb
44 hanger
46 Christmas tree
48 support surface
50 geometric shape for 24
52 removing and interchanging assembly
54 transparent segment in 24
56 sliding track in 24 at 54
58 slot opening in 20
60 tile
62 groove in 60

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. In combination, a tree, a plurality of illuminated information conveying signs hanging on and distributed throughout the branches of said tree, each said illuminated sign comprising:

a) a housing comprising a bottom wall, a pair of end walls, each extending upwardly from opposite sides of said bottom wall, a rear wall extending upwardly from the back of said bottom wall between said end walls, a front wall extending upwardly from the front of said bottom wall between said end walls, and a top wall extending over said bottom wall, between said end walls, said rear wall and said front wall forming a chamber therein;

b) said front wall having a transparent segment extending horizontally thereacross, a sliding track built into said front wall at said transparent segment, and having a slot opening located in one said end wall, and a plurality of tiles, each having grooves to engage individually with said sliding track, in which some of said indicia is printed on each of said tiles, so that said tiles in any combination can be inserted separately through said slot opening and moving along said sliding track until said tiles are in a side by side relationship; and c) means comprising string lights having bulbs extending into the interior of each off said housings for providing illumination within each of said illuminated signs.

* * * * *